United States Patent [19]

Pogwizd

[11] 4,007,807

[45] Feb. 15, 1977

[54] LADDER STABILIZER

[76] Inventor: Kenneth W. Pogwizd, 16 W. 709 56th Place, Clarendon Hills, Ill. 60514

[22] Filed: May 27, 1975

[21] Appl. No.: 580,664

[52] U.S. Cl. ..... 182/109

[51] Int. Cl.[2] ..... E06C 7/42; E06C 5/36

[58] Field of Search ..... 182/107, 108, 109, 111

[56] References Cited

UNITED STATES PATENTS

| | | | |
|---|---|---|---|
| 530,374 | 12/1894 | Wilkins | 182/107 |
| 776,446 | 11/1904 | Williamson | 182/107 |
| 846,228 | 3/1907 | Miller | 182/175 |
| 1,479,262 | 1/1924 | Stegeman | 182/108 |
| 1,973,226 | 9/1934 | Rose | 182/109 |
| 1,982,572 | 11/1934 | Colglazier | 182/107 |
| 2,523,535 | 9/1950 | Little | 182/107 |
| 3,432,003 | 3/1969 | La Pierre | 182/107 |

FOREIGN PATENTS OR APPLICATIONS

| | | | |
|---|---|---|---|
| 231,827 | 3/1911 | Germany | 182/107 |

*Primary Examiner*—Reinaldo P. Machado
*Attorney, Agent, or Firm*—Alter and Weiss

[57] ABSTRACT

A chain-and-anchor system stabilizes a standard ladder being used on penetrable or impenetrable surfaces. A chain, secured at either end to one of the ladder rails is held taut by an anchor; at the same time, anti-slip devices prevent ladder from shifting. For use on penetrable surfaces, the anchor and anti-slip devices are penetrating spikes, while for impenetrable surfaces, a weight box is used as an anchor, while anti-skid material fastened to the ladder rail ends serves as anti-slip devices.

4 Claims, 7 Drawing Figures

LADDER STABILIZER

My invention relates generally to ladder safety devices and more particularly to a combination anchor-and-chain arrangement to stabilize ladders and prevent them from slipping while in use.

Carpenters, house painters, and other workmen whose trades require the use of ladders are well aware of the hazards created when a ladder must be leaned against a wall, or the like, for stability. Often, the angle at which a ladder must be erected is determined by limitations of available space or by the workman's need to stand near the top of the ladder rather than any considerations of stability or safety. In such situations, the ladder becomes less stable as the workman mounts higher on the rungs. In the course of using paint brushes, tools or other devices, a workman may shift his weight uncautiously enough to cause the base of the ladder to break contact with the ground, allowing the ladder to slip and fall. Serious injury often accompanies such accidents, not only from striking the ground, but from being struck by tools or materials as they fall from the ladder. When ladders are used to support scaffolding, ladder stability takes on even more importance since typically, such scaffolding supports not only several workmen, but heavy objects such as paint cans, tubs of caulking and patching compounds, or heavy tools.

No universally satisfactory solution to ladder stability has heretofore been found. Ladders are used for a myriad of purposes over a wide variety of work surfaces, and stabilizing means adequate for one set of conditions often prove unsuited for others. As an example, spikes driven into the ground at the base of the ladder are useful when working out of doors but would do considerable damage if used indoors on a hardwood floor. Such spikes cannot be used when working on asphalt or concrete surfaces. Conversely, non-skid pads or feet on the ladder stiles are of little use in soft or freshly spaded earth, or on sloped or hilly terrain.

Past attempts at ladder stabilization have often involved apparatus which, when installed, extended some distance from the ladder. Passersby, whose attention might be attracted by the workman at the top of the ladder, ran the risk of stumbling over such apparatus which in turn, could cause the ladder to fall.

It is an object of my invention to provide a simple, easy to use ladder stabilizer which is universally adaptable to different terrains and working conditions.

A further object of my invention is to design such as a stabilizer to be easily and inexpensively installed on any standard ladder without requiring special tools or skills.

Yet another object of my invention is to provide a ladder stabilizer system which packs easily and conveniently into its own carrying case for transportation from job site to job site.

Another object of my invention is to provide a stabilizer system which, when being used, fits under the ladder, out of the way of any passersby.

Yet, another object of my invention, is to provide a ladder stabilizer which would make the erection and use of scaffolding safer and more secure.

Other and future objects will become readily apparent upon a study of the accompanying specifications and drawings, wherein.

Figure 1:
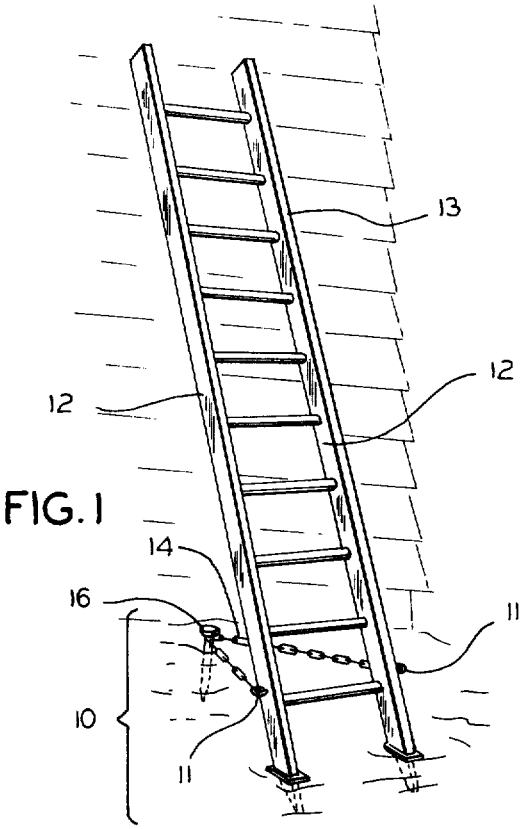
FIG. 1 is a perspective view of a ladder secured in place by my invention.
Figure 2:
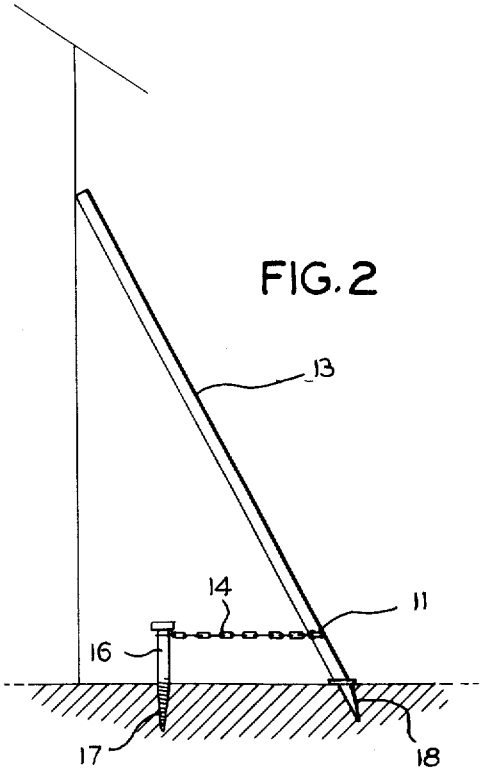
FIG. 2 is a side view of the configuration shown in FIG. 1.
Figure 3:
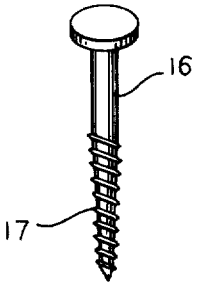
FIG. 3 is a perspective view of the anchoring spike.
Figure 4:
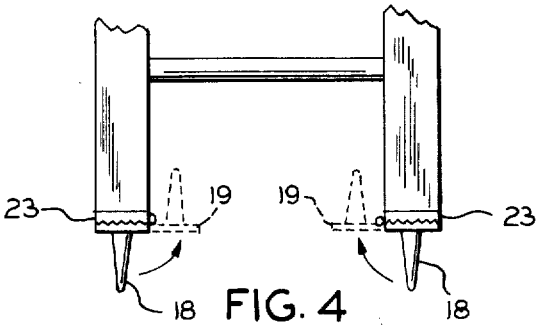
FIG. 4 is a front view of the ladder prongs, showing, in phantom, their position when not in use.
Figure 5:
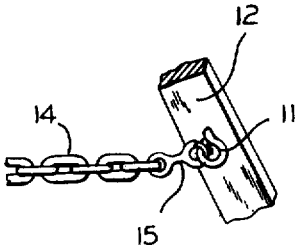
FIG. 5 is a partial perspective view of the chain safety snap fastened to the clip ring.
Figure 6:
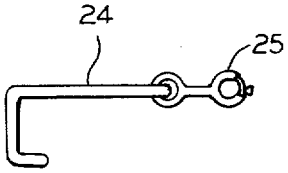
FIG. 6 is an elevation of the rung hook.
Figure 7:
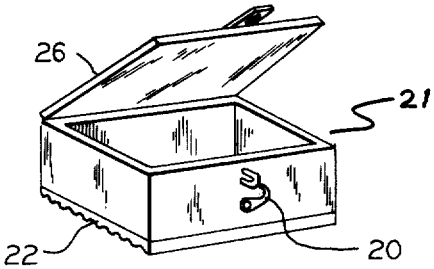
FIg. 7 is a perspective view of the combination weight box/carrying case.

A preferred embodiment of my invention may be seen by referring to FIG. 1, wherein the numeral 10 indicates generally the ladder stabilizer system. Clip rings 11 are threadably, or otherwise suitably fastened to the outside surfaces of ladder stiles 12 at a point near the lower end of ladder 13. Each end of chain 14 is fastened to one clip ring 11 by a safety clasp 15 permanently affixed to said chain end. An anchor stake 16 is driven into the ground at a distance from ladder 13 sufficient to take up the slack in chain 14 when safety clips 15 are fastened to clip rings 11 and said chain 14 is directed about anchor stake 16. As shown as 17, anchor stake 16 may be threaded or sharpened to make it easier to drive into the ground. Ladder prongs 18 are hingeably fastened to the bottoms of stiles 12, and pivot up as shown at 19 when not in use.

When the ladder is intended to be used indoors or outdoors or hard surfaces such as concrete or flag stone, use of the anchor stake 16 and ladder prongs 18 is precluded. To utilize the stabilizer system, chain 14 is fastened at its mid-point to hook 20 on weight box 21. Weight box 21 is then moved a sufficient distance away from ladder 13 to take up the slack in chain 14 and weights, such as vinyl covered bricks, scrap metal, or the like are placed in weight box 21 to secure it from moving when the ladder is used. A non-skid surface 22 on the weight box, and similar surfaces 23 on ladder stiles 12 further ensures that no ladder movement will take place.

An alternative anchor means, adapter hook 24, can be used to take advantage of any convenient ledges, curbs, or the like. Clip ring 25 is fastened to the mid-point of chain 14, after which adapter hook 24 then engages said ledge, curb or the like. When not in use, or when being transported from job to job, stake 16, chain 14, and adapter 24 may be placed in weight box 21 and secured by lid 26 which is removably attached to said weight box.

A workman using my invention would carry it to the job site along with his other tools. If the job is to be performed outdoors, and the ladder will be resting on soil or grass, the workman would pivot the ladder prongs 18 downward prior to placing the ladder in position. The workman would then drive the prongs into the ground by, for example, standing on the lowermost rung of the ladder. Once the prongs are securely buried, the chain 14 is then clipped to the ladder stiles 12 by means of clip rings 11 fastened to the stiles, and safety clips 15, fastened to each end of the chain.

The anchor stake 16 is next uitlized in order to locate the stake properly, the workman first grasps chain 14 at its midpoint and pulls it taut in a direction toward the edifice against which the ladder is resting. The anchor stake 15 is then driven into the ground such that the chain 14, when passed around the anchor stake, 15, will remain taut, preventing the base of the ladder from shifting away from its support. Chain 14 is then unclipped at one end, passed around anchor stake 15, and refastened to ladder stile 12.

Adapter hook 24 may be used with chain 14 when, instead of using anchor stake 15, it is desired to anchor the ladder to a curb, windowsill, or the like, which may be conveniently located near the site where the ladder is being used. Safety clip 25 is then fastened to the midpoint of chain 14, after the adapter hook 24 has been positioned at such curb or windowsill.

When the adapter hook cannot be used, and the surface upon which the ladder stands is too hard for penetration by prongs 18 and stake 16, the workman pivots prongs 18 to their uppermost position, revealing non-skid surface 23 at the bottom of each ladder stile 12. Chain 14 is then fastened, by safety clips 15, to clip rings 11; but, instead of being passed about stake 16, chain 14 is then secured at its midpoint to hook 20 on weight box 21. Any suitably heavy material, such as bricks, scrap iron, or the like is then placed in the box. Such weight and the non-skid surface 22 on the bottom of box 21, effectively act as a firm anchor, preventing the outward movement of the ladder as the workman mounts it.

It is to be understood that the above description of my invention is made by way of example only and not as a limitation on the scope of the invention.

I claim:

1. A universal ladder stabilizer system for straight ladders having side rails, comprising:

anchor means, flexible connecting means, said flexible connecting means extending between a ladder and said anchor means;

means to removably couple said connecting means to the side rails of said ladder; and slip preventing means, said slip preventing means fixedly attached at the lowermost portion of each said side rail, said slip preventing means comprising non-slid surface means at said lowermost portion of each said side rail to prevent slippage of said ladder on non-penetrable surfaces and alternatively positionable ladder prong means which are positionable directly under said non-skid surface means in abutment therewith to more effectively prevent slippage of said ladder on penetrable surfaces.

2. The apparatus as recited in claim 1, wherein:

said anchor means comprises spike means, said spike means being removably insertable into said penetrable surface.

3. The apparatus as recited in claim 1 wherein:

said anchor means comprises an open top receptacle positioned atop said non-penetrable surface, said receptacle having an exterior lowermost surface faced with a non-skid material directly juxtaposed to said non-penetrable surface, said receptacle being adapted to receive material of sufficient weight and mass to deter slippage between said receptacle and said penetrable surface.

4. The invention according to claim 1 in which said connecting means comprises chain means, said chain means having two ends, each of said two ends of said chain means being removably coupled to the side rails of said ladder, and said anchor means being adapted to hold said chain means taut when said ends are attached to the side rails of said ladder.

* * * * *